US007287472B2

(12) United States Patent
Rogge et al.

(10) Patent No.: US 7,287,472 B2
(45) Date of Patent: Oct. 30, 2007

(54) PRINTING UNIT WITH INK TRANSFER ROLLER AND BEARING BLOCKS INCLUDING SUPPORT ELEMENTS FOR INK CHAMBER

(75) Inventors: Guenter Rogge, Lienen (DE); Hans-Joerg Mieseler, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/542,143

(22) PCT Filed: Jan. 14, 2004

(86) PCT No.: PCT/EP2004/000413

§ 371 (c)(1),
(2), (4) Date: Jul. 13, 2005

(87) PCT Pub. No.: WO2004/067279

PCT Pub. Date: Aug. 12, 2004

(65) Prior Publication Data

US 2006/0150843 A1 Jul. 13, 2006

(30) Foreign Application Priority Data

Jan. 31, 2003 (DE) ..... 103 04 109

(51) Int. Cl.
*B41F 31/00* (2006.01)
*B41F 31/30* (2006.01)

(52) U.S. Cl. ..... 101/352.01; 101/216; 101/247

(58) Field of Classification Search ..... 101/350.6, 101/485, 216, 247, 352.01, 351.1, 352.07
See application file for complete search history.

(56) References Cited

U.S. PATENT DOCUMENTS

| | | | | |
|---|---|---|---|---|
| 4,590,855 | A * | 5/1986 | Schommer et al. | 101/157 |
| 5,906,162 | A * | 5/1999 | Kolbe et al. | 101/352.01 |
| 5,974,968 | A * | 11/1999 | Achelpohl et al. | 101/247 |
| 6,220,162 | B1 * | 4/2001 | Kolbe et al. | 101/484 |
| 6,324,976 | B1 | 12/2001 | Thoele et al. | |
| 2005/0166774 | A1 * | 8/2005 | Blom et al. | 101/216 |
| 2005/0211117 | A1 * | 9/2005 | Koopmann | 101/216 |

FOREIGN PATENT DOCUMENTS

| | | | |
|---|---|---|---|
| DE | 197 05369 | A1 | 9/1998 |
| DE | 198 48 773 | A1 | 5/2000 |
| DE | 100 24 350 | A1 | 11/2001 |

* cited by examiner

*Primary Examiner*—Leslie J. Evanisko
(74) *Attorney, Agent, or Firm*—Jacobson Holman PLLC

(57) ABSTRACT

A printing unit of a printing machine has at least one ink transfer roller, and at least one bearing block movable relative to the printing unit frame, in which, in the printing position, one end of the ink transfer roller can be supported, and which releases that end of the ink transfer roller in its released position. The unit has a blade chamber holder which carries at least one blade chamber that can be adjusted on the ink transfer roller and which is connected rotatably and displaceably with the bearing block in the printing position. The blade chamber holder is supported permanently on the bearing block by support elements on the bearing block.

20 Claims, 7 Drawing Sheets

PRINTING UNIT WITH INK TRANSFER ROLLER AND BEARING BLOCKS INCLUDING SUPPORT ELEMENTS FOR INK CHAMBER

BACKGROUND OF THE INVENTION

1. Field of Invention

This is a nationalization of PCT/EP2004/000413 filed 14 Jan. 2004 and published in German.

The invention relates to the printing unit of a printing machine. The printing unit includes an ink transfer roller, a bearing block movable relative to a printing unit frame, and a blade chamber holder.

2. Description of the Prior Art

Printing machine of this kind is known from the DE 197 05 369 A1. In that design, the pressure and ink transfer rollers are supported on their first ends, each with overhanging one end in a bearing block supported by guide rails. In order to avoid vibrations of the rollers during the press operations, their second ends are supported with the help of prop bearings, which, in their turn, are mounted on the bearing blocks. The prop bearings can be released from the rollers and can move together with the bearing blocks. Thus, the second, free ends of the rollers can be released, for example, for the purpose of changing the sleeves or for other tasks. Since the bearing blocks carrying the prop bearings must be moved, but the bearing blocks in which the rollers are supported overhanging are held fast, it is also necessary to release the blade chamber which connects both the bearing blocks, or the blade chamber holder of the bearing block, which carries the prop bearing. For that purpose, in the known types of printing machines, in the printing position of the bearing block, pins are inserted into the bore holes interspersed in the bearing blocks that carry the prop bearing, which also grip tapped blind holes made in the blade chamber holder of the coater chamber. Now, if this bearing block is to be moved, the fixed connection between blade chamber holder and bearing block are separated by taking out the pins. The disadvantage of such a device is that the blade chamber holder is then supported by the printing machine frame, whereby the blade chamber buckles through due to the distance between blade chamber holder and the printing machine frame. At the same time it can also result in slipping movements in case of printing units not built in horizontal position, so that damage to the ink transfer roller cannot be ruled out.

SUMMARY OF THE INVENTION

Therefore the task posed by the present invention is to propose an arrangement for the printing unit, in which possible displacement and buckling of the blade chamber are avoided after loosening the fixed attachment with the bearing block.

This task is solved by permanently propping up the blade chamber holder associated with the second bearing block by means of supporting elements on the second bearing block. Therefore, the blade chamber holder does not need to be completely released from the second bearing block. The blade chamber and the blade chamber holder supporting it need no longer be set down on the printing machine frame. Furthermore, the manual work connected with the loosening and retightening of the connections between the blade chamber holder and the bearing block need not be done any more.

Thereby, it is especially advantageous if the supporting elements consist of at least a linear guide, which is attached to the blade chamber holder in such a fashion that, the second bearing block is displaceable relative to the blade chamber holder. In that manner, the bearing block can be displaced without causing deformation of the blade chamber due to the lifting and the lowering movements.

It is of advantage if the supporting elements are comprised of a track fixed on the blade chamber holder and a guiding slot is firmly connected with the bearing block. It is thus possible to move the bearing block relative to the blade chamber holder for releasing the free end of the printing roller without needing to completely separate the blade chamber holder from the bearing block.

Should the bearing block be brought into the release position, then, in a preferred embodiment, the blade chamber holder is arrested in the printing unit frame. With that the buckling of the blade chamber as a result of slipping at an end side of the printing unit that is not horizontally arranged is avoided and consequently possible damage to the surface of the ink transfer roller are forestalled.

Thereby, it is especially advantageous if the blade chamber holder is alternately attached with the bearing block or the printing unit frame. For that purpose, it can be equipped with a stop bolt attached displaceably with the blade chamber holder, which connects the blade chamber holder firmly at one of its end positions with the bearing block and at its other end position, it grips into a recess of the printing device frame.

In order to rule out releasing of the stop bolt from the described end position by accident, it is advantageous to provide an elastic thrust pad on the blade chamber holder. Thereby the ball of the elastic thrust pad grips a groove made in the stop bolt.

In order to ensure a tight fit between the blade chamber holder and the anilox roller block, it is of advantage if a stop plate is fixed on the anilox roller block, which can be clamped between the stop bolt and a stopper.

In order to prevent the play that appears after frequent displacement of the stop bolt between the stopper plate and the stop bolt, in a preferred embodiment, both the elements are provided in the mutually facing areas with mutually parallel slant, so that the play due to the changes in the distance adjustment of the stop bolt is eliminated.

If the blade chamber holder must be fixed on a printing unit frame, it is of advantage to equip it with a receiver fixed on the printing unit frame for that purpose.

It is of advantage if a means for actuating displacement can act on the stop bolt.

In a preferred embodiment, the means for the displacement of the stop bolt is comprised of a drive unit, as well as a means for transmitting the driving force.

Thereby a piston cylinder unit can be provided as the drive unit.

BRIEF DESCRIPTION OF THE DRAWINGS

It is of advantage thereby if the means for transmitting the drive force is comprised of a receiver attached to the piston of the piston cylinder unit, which encloses a pin fixed on the stop bolt in the print position of the anilox roller block. It is thus possible to provide the piston cylinder unit on the anilox roller block. This type of arrangement offers the advantage that the leads to the driver of the piston cylinder unit can be laid parallel to other devices located, driven or actuated through the anilox roller block.

An instance of an embodiment of the invention is explained in detail with the help of the drawings. The individual figures show.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
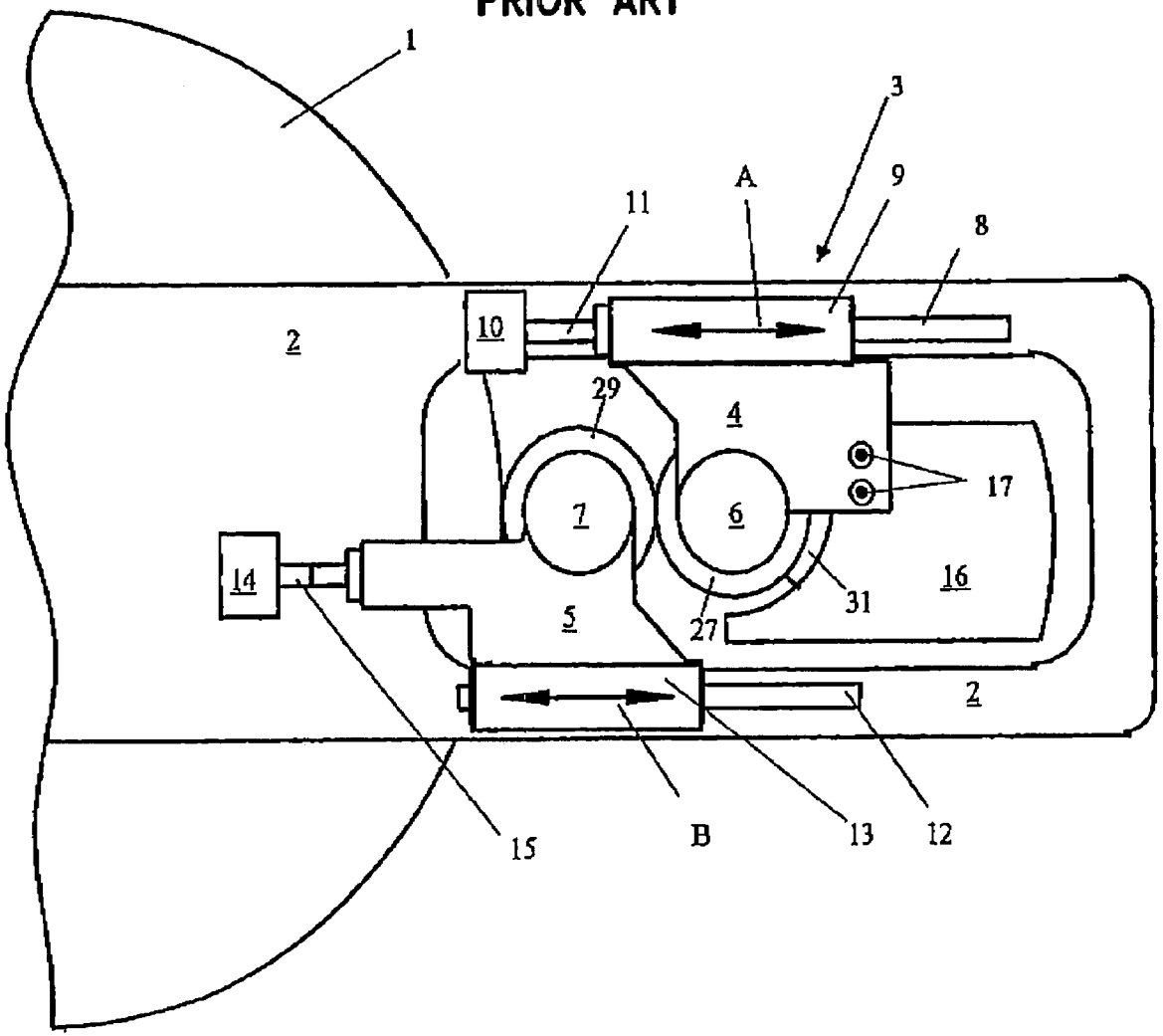
FIG. 1 PRIOR ART
FIG. 1 Side view of a printing unit of a flexo-printing machine of known type FIG. 2 Side view of a section of a printing unit of the type according to invention, whereby the anilox roller block is in the release position.

FIG. 1 shows a flexo-printing machine of the known type in printing position. A counter-pressure cylinder 1, on which the length of material sheet to be printed, not shown in detail here, is guided, is supported in a machine frame, not shown here. A printing unit frame 2, which is a part of the printing unit 3, is firmly attached with the machine frame. The rear printing unit frame, which is attached to the backside of the counter-pressure cylinder on the machine frame, is not visible here. In a flexo-printing machine, several inking units of this type, distributed across the periphery of the counter pressure cylinder, can be provided. During the printing operation, the printing roller 29 is supported by means of prop bearing 7. The prop bearing is supported by the printing roller frame, which is supported across the sled 13 on the guide track 12 and can be moved to and fro, along double arrow B, by means of the motor 14 and the spindle 15. The guide rail 12 is connected firmly with the printing unit frame.

The anilox roller 27 is supported on anilox roller bearing block 4 by a prop bearing 6. The sled 9, which runs along the track 8 fixed on the printing unit frame 2 and on which the anilox roller bearing block 4 is held fast, can be displaced, along double arrow A, by means of the motor 10 and the spindle 11. An ink chamber coater blade 31 is fixed on the blade chanter holder 16 in a manner not further described in detail here. This blade chamber holder 16 is fastened to the anilox toller block 4, in a manner secured against twists and movements, using two bolts 17, which grip through bore holes in the anilox roller bearing block 4 and grasp into the two bore holes of the blade chamber holder.

Now, in order to be able to remove, for example, the anilox roller sleeve from the cylinder core of the anilox roll, first the anhlox roller block is detached from the printing roller (Printing-Off position). After that, the anilox roller block 4 must be displaced relative to the anilox roller 27 after releasing the prop bearing 6 from the anilox roller 27. For that purpose, the blade chamber holder 16 must be separated from the anilox roller bearing block 4 by pulling out both the bolts 17. After the separation, the anhlox roller block 4 can be moved into the socalled Release position.

Figure 2:
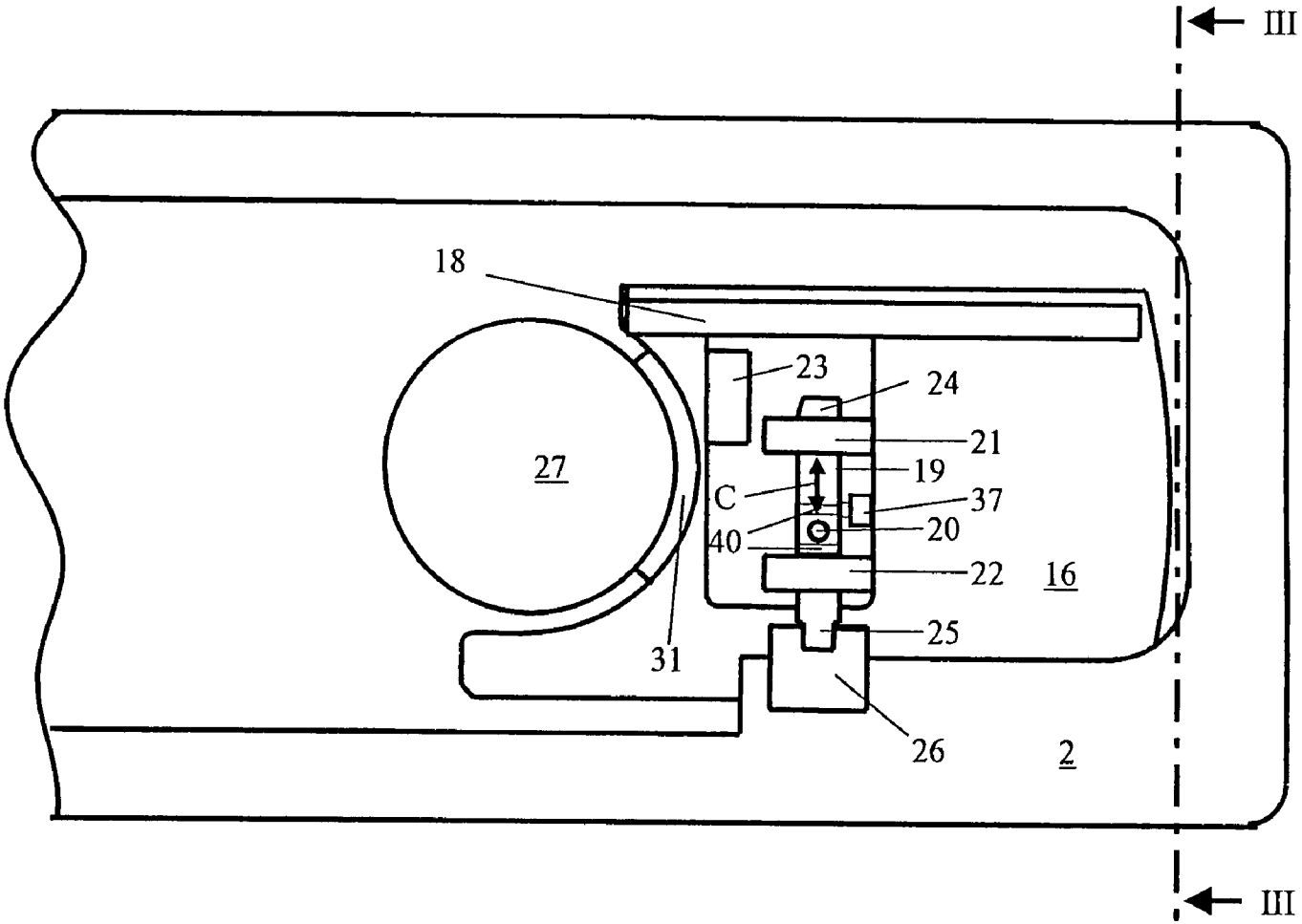
Figure 3:
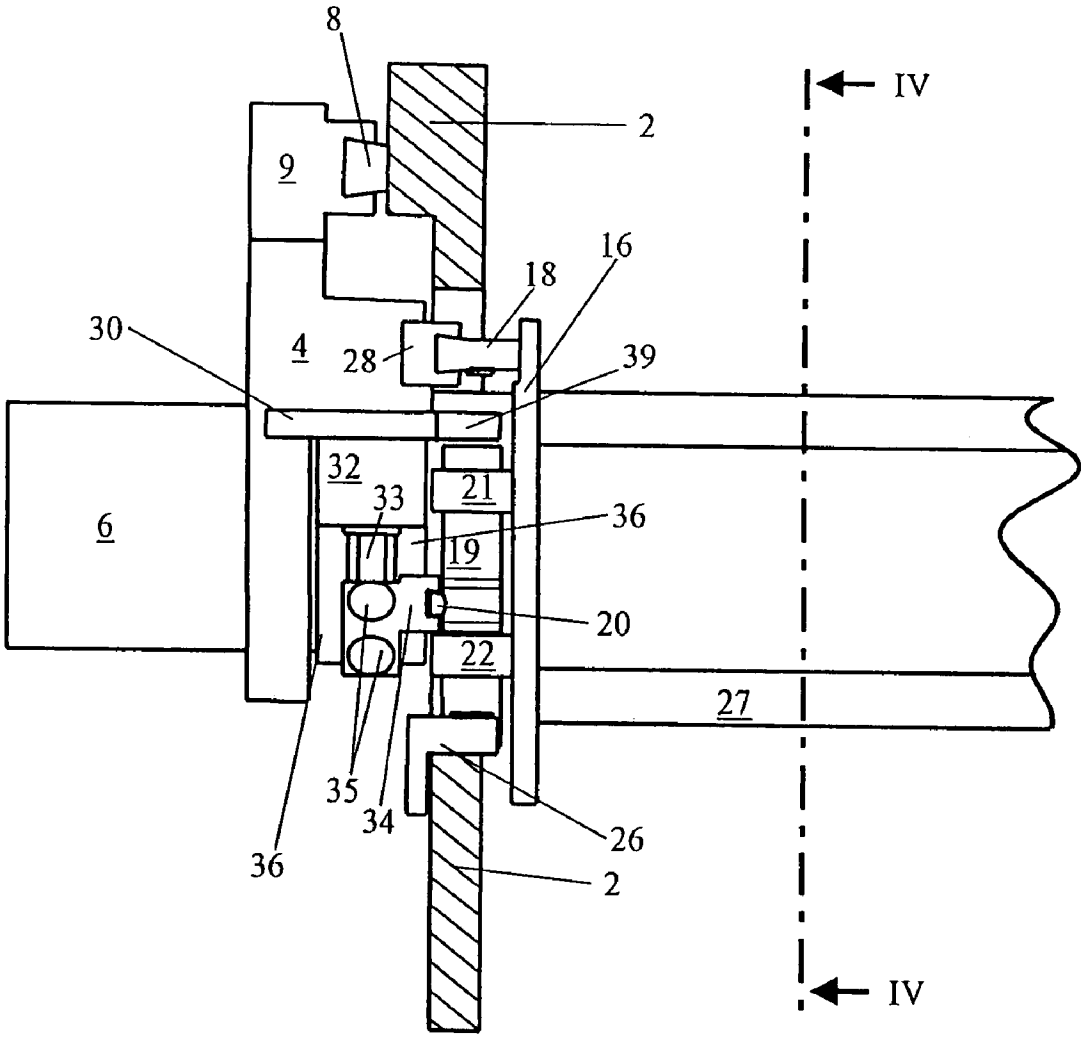
FIG. 3 View of the inking unit according to FIG. 2.
Figure 4:
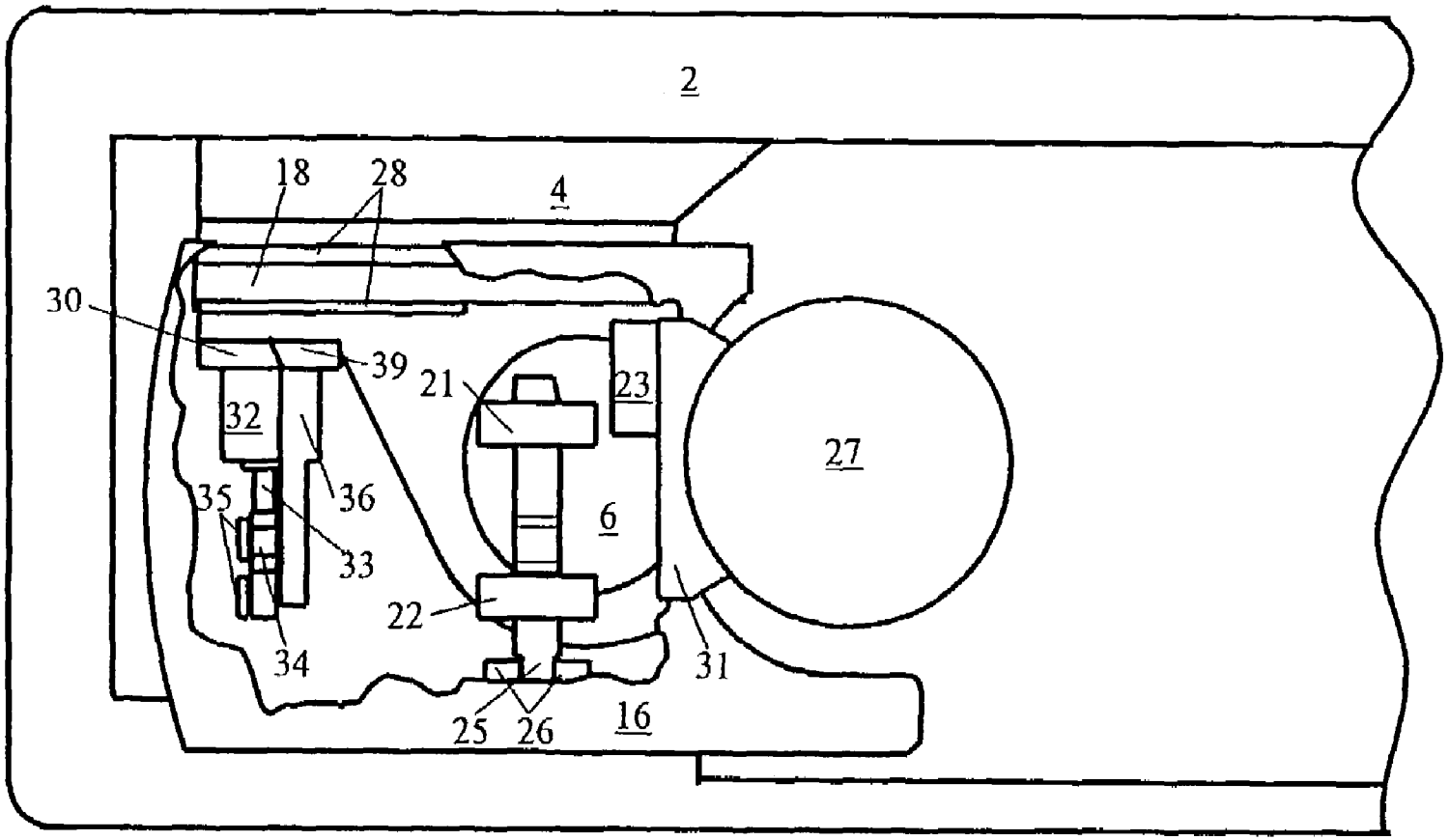
FIG. 4 View of the inking unit according to FIG. 3.

Now, the FIGS. 2 to 4 show a section of the printing unit according to the invention. Display of the anilox roller bearing block 4 with the prop bearing as well as the guide elements is not shown in FIG. 2 for the sake of simplicity. The anilox roller is in the Printing-Off position and the bearing block 4 is in the Release position, which enables access to the anilox roll. On the blade chamber holder 16, a guide track 18 is fastened, which is enclosed by the guide wagon 28 displayed in FIG. 3. This guide wagon 28 is attached on its part to the anilox roller bearing block 4. The stop bolt 19 is displaceable in the guides 21, 22 along arrow C. In the state of operation shown here, the stop bolt 19 is mounted above the stop bolt base 25 in the stop bolt support seat 26. In order to prevent an unintentional displacement of the stop bolt 19, an elastic thrust pad 37 is mounted in the blade chamber holder 16. The ball of the elastic thrust pad 37 acts thereby on a snap ring groove 40, which is mounted at the corresponding position in the stop bolt 19. The elastic thrust pad is not shown in FIG. 3 and FIG. 4 for the sake of better overview. The stop bolt seat is firmly fastened with the printing unit frame 2. At the anilox roller bearing block 4, a stopper plate 30 is fixed, which is comprised of a jut 39. The jut 39 is beveled on one side. The jut 39 and the bevel slant are thereby so dimensioned that the jut 39 can be arrested with the stop bolt head 24 and the stopper 23. Below the stopper plate 30, a piston cylinder unit 32 is fixed, whose piston 33 protrudes downward. On the piston is a receiver 34, as well as two rolls 35 are fastened on each of the two sides. The rolls 35 pass through the roll guides 36, 38 of which only the roll guide 36 is shown.

Figure 5:
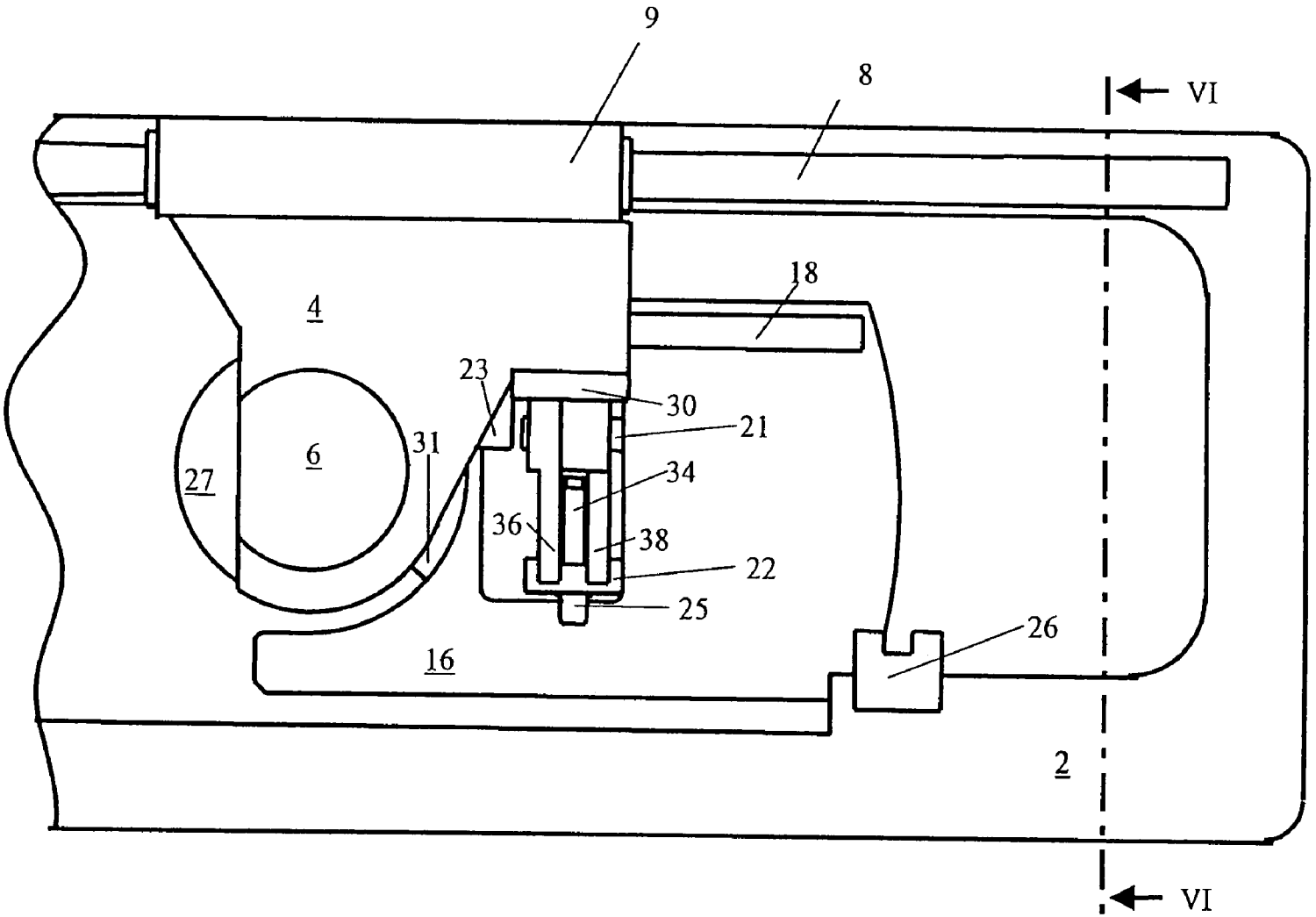
FIG. 5 Side view of a section of a printing unit of the type according to the invention, in which the anilox roller block is in printing position.
Figure 6:
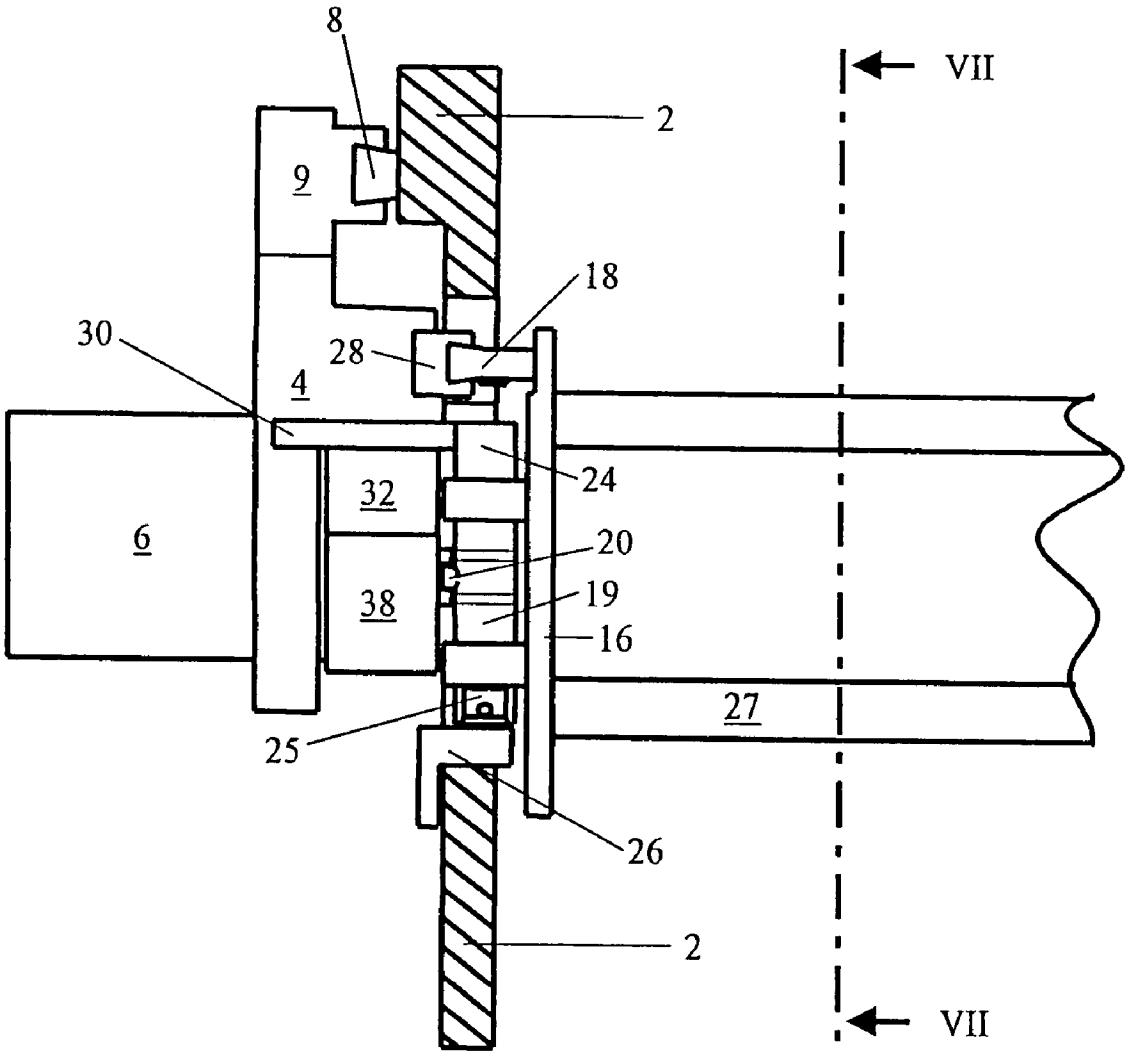
FIG. 6 View of the inking unit according to FIG. 5.
Figure 7:
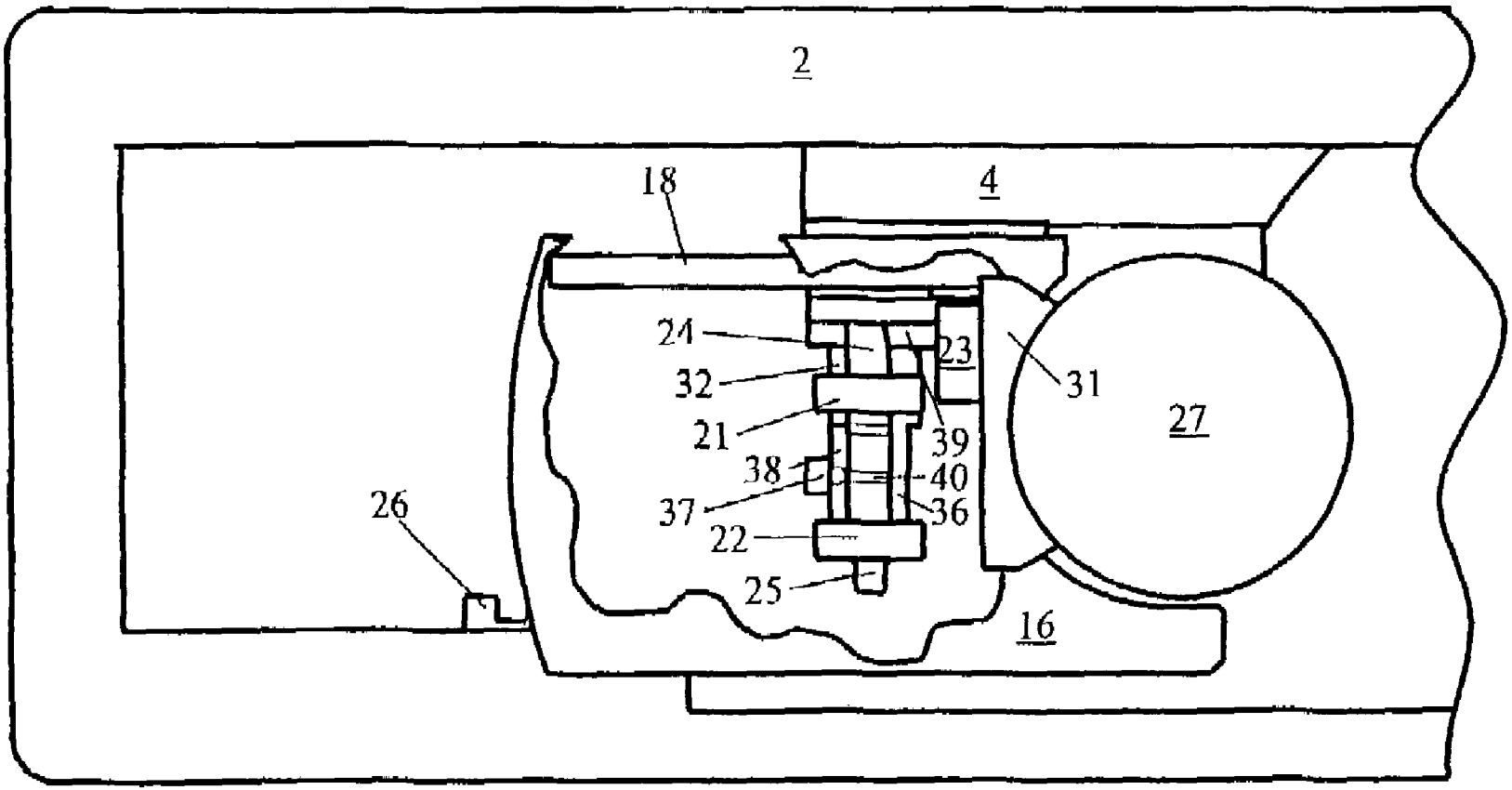
FIG. 7 View of the inking unit according to FIG. 6.

The FIGS. 5 to 7 show the same section of the printing unit according to the invention, whereby the anilox roller bearing block 4 is in the printing position. In order to reach this position, the anilox roller bearing block 4 is displaced in the direction toward the anilox roller 27, so that the prop bearing 6 can enclose the free end of the anilox roll. In that position of the anilox roller block, the receiver 34 mounted on the piston 33 also enclosed the pin 20 fastened in the stop bolt 19. Through actuation of the piston cylinder unit 32, the stop bolts can be displaced upwards and thereby clamp the jut 39 of the stopper plate between the stopper 23 and the stop bolt head 24. A constant application of pressure exerted through the piston cylinder unit 32 ensures, due to the slants of the jut 39 and the cylinder head 38, clamping of the jut 39 free of play. Thus a reproducibly exact position of the blade chamber holder relative to the anilox roller block is enabled. However if, in a faulty operation, the pressure exerted by the piston cylinder unit 32 is absent, the stop bolts 19 can slide into a position, in which, as shown in FIG. 7, the ball of the elastic thrust pad 37 can act on the lower snap ring groove 40, so that farther movement of the stop bolt 19 is forestalled. Thus, even in case of absence of the pressure, adequate clamping of the jut 39 is ensured.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| LIST OF REFERENCE SYMBOLS | |
|---|---|
| 1 | Counter-pressure cylinder |
| 2 | Printing unit frame |
| 3 | Printing unit |
| 4 | Anilox roller bearing block |
| 5 | Press roller block |
| 6 | Prop bearing for anilox roller |
| 7 | Prop bearing for pressure roller |
| 8 | Guide tracks for anilox roller block |
| 9 | Sleds |
| 10 | Motor |
| 11 | Spindle for anilox roller block |
| 12 | Guide tracks for pressure roller block |
| 13 | Sleds for anilox roller block |
| 14 | Motor |
| 15 | Spindle for pressure roller block |
| 16 | Blade chamber holder |
| 17 | Fixing bolts |
| 18 | Track |
| 19 | Stop bolts |
| 20 | Pin |
| 21 | Guide |
| 22 | Guide |
| 23 | Stopper |
| 24 | Stop bolt head |
| 25 | Stop bolt foot |
| 26 | Stop bolt seat |
| 27 | Anilox roller |
| 28 | Guide wagon |
| 29 | Pressure roller |
| 30 | Stopper plate |
| 31 | Ink chamber blade |
| 32 | Piston cylinder unit |
| 33 | Piston |
| 34 | Receiver |
| 35 | Rolls |
| 36 | Roll guide |
| 37 | Elastic thrust pad |
| 38 | Roll guide |
| 39 | Jut |
| 40 | Snap ring groove |
| A | Direction of movement of anilox roller block |
| B | Direction of movement of pressure roller block |
| C | Direction of movement of stop bolt |

What is claim is:

1. A printing unit of a rotary printing machine comprising:

at least one ink transfer roller, whereby the first end of the ink transfer roller is supported rotatably on a first bearing block, whereby the second end of the ink transfer roller is supported by a prop bearing connected rotatably with a second bearing block, whereby the prop bearing can be released from the ink transfer roller and the second bearing block is displaceable relative to the ink transfer roller and relative to the first bearing block, so that the second end of the ink transfer roller is freely accessible, whereby the second bearing block is associated with a blade chamber holder, which carries at least one ink chamber blade, which is adjustable on the ink transfer roller, and whereby the blade chamber holder is at rest with respect to the first bearing block during the displacement of the second bearing block characterized in that the blade chamber holder is permanently supported by support elements on the second bearing block.

2. The printing unit according to claim 1, characterized in that the support elements include at least a linear guide, which is arranged on the blade chamber holder such that the second bearing block is displaceable relative to the blade chamber holder.

3. The printing unit according to claim 1, characterized in that the support elements include at least one track fixed on the blade chamber holder and at least one guide wagon fastened on the second bearing block enclosing the track.

4. The printing unit according to claim 1, characterized in that the blade chamber holder is connected with a printing unit frame in each position of the second bearing block which is not a printing position.

5. The printing unit according to claim 1, characterized in that a stop bolt is displaceably supported along its axis on the blade chamber holder, and can be connected at one of its end positions with the second bearing block and with its other end position with a printing unit frame.

6. The printing unit according to claim 5, characterized in that the stop bolt is fastened in each of these end positions by a ball of an elastic thrust pad, which is mounted on the blade chamber holder, whereby the ball acts on a groove in the stop bolt foot.

7. The printing unit according to claim 5, characterized in that in the printing position, a jut is clamped on a stopper plate fastened on the second bearing block between the stop bolt and a stopper.

8. The printing unit according to claim 7, characterized in that the jut and the stop bolt include slanting bevels running parallel on mutually facing sides thereof.

9. The printing unit according to claim 5, characterized in that for connection of the blade chamber holder with the printing unit frame the stop bolt is fastened in a receiver fastened on the printing unit frame.

10. The printing unit according to claim 5, characterized in that a displacement device acts on the stop bolt.

11. The printing unit according to claim 10, characterized in that the displacement device includes a drive unit and a device for transmitting a driving force.

12. The printing unit according to claim 11, characterized in that the drive unit includes a piston cylinder unit.

13. The printing unit according to claim 11, characterized in that the device for transmitting the driving force includes a receiver, which encloses a pin fastened on the stop bolt in the printing position of the second bearing block.

14. A printing unit for a rotary printing machine, comprising:

an ink transfer roller with a first end rotatably supported on a first bearing block, and a second end supported by a prop bearing rotatably connected with a second bearing block, the prop bearing being releasable from the ink transfer roller and the second bearing block being displaceable relative to the ink transfer roller and to the first bearing block;

a blade chamber holder with an ink chamber blade adjustable relative to the ink transfer roller; and a second bearing block support for supporting the blade chamber holder such that the blade chamber holder remains in place with respect to the first bearing block during the displacement of the second bearing block.

15. The printing unit according to claim 14, wherein the second bearing block support includes a guide track on the blade chamber holder and a guide wagon on the second bearing block for traveling the track.

16. The printing unit according to claim 14, further comprising a printing unit frame for supporting the blade chamber holder and a stop bolt displaceably supported on the blade chamber holder, wherein the stop bolt is connected at a first end with the second bearing block and at a second end with the printing unit frame.

17. The printing unit according to claim 16, further comprising a displacement device for positioning the stop bolt such that positioning of the stop bolt positions the second bearing block relative to the blade chamber holder.

18. The printing unit according to claim 17, wherein the displacement device includes a piston cylinder unit for providing a driving force, and a device for transmitting the driving force that includes a receiver enclosing a pin positioned on the stop bolt in a printing position of the second bearing block.

19. A printing unit for a rotary printing machine, comprising:

an ink transfer roller with a first end rotatably supported on a first bearing block, and a second end supported by a bearing rotatably connected with a second bearing block, the prop bearing being releasable from the ink transfer roller and the second bearing block being displaceable relative to the ink transfer roller and to the first bearing block;

a blade chamber holder with an ink chamber blade adjustable relative to the ink transfer roller;

a second bearing block support for supporting the blade chamber holder such that the blade chamber holder remains in place with respect to the first bearing block during the displacement of the second bearing block; and a displacement device for positioning the second bearing block relative to the blade chamber holder.

20. The printing unit according to claim 19, wherein the displacement device provides a reproducibly exact positioning of the second bearing block relative to the blade chamber holder to provide a desired positioning of the blade chamber holder relative to the ink transfer roller.

* * * * *